United States Patent [19]

Salomon

[11] 4,280,714

[45] Jul. 28, 1981

[54] SAFETY BINDINGS FOR SKIS

[75] Inventor: Georges P. J. Salomon, Annecy, France

[73] Assignee: S.A. Etablissements Francois Salomon & Fils, Annecy, France

[21] Appl. No.: 51,425

[22] Filed: Jun. 25, 1979

Related U.S. Application Data

[63] Continuation of Ser. No. 845,456, Oct. 25, 1977, abandoned.

[30] Foreign Application Priority Data

Nov. 4, 1976 [FR] France ..... 76 33218

[51] Int. Cl.[3] ..... A63C 9/08

[52] U.S. Cl. ..... 280/611; 280/612

[58] Field of Search ..... 280/612, 611

[56] References Cited

U.S. PATENT DOCUMENTS

| | | | |
|---|---|---|---|
| 3,762,735 | 10/1973 | Smolka | 280/612 |
| 3,774,922 | 11/1973 | Smolka et al. | 280/612 |
| 3,802,715 | 4/1974 | Turnheim et al. | 280/612 |
| 3,892,980 | 7/1975 | Anderson | 280/612 X |
| 3,919,563 | 11/1975 | Lautier et al. | 280/612 |

FOREIGN PATENT DOCUMENTS

| | | | |
|---|---|---|---|
| 2519544 | 11/1975 | Fed. Rep. of Germany | 280/612 |

*Primary Examiner*—John J. Love
*Assistant Examiner*—Milton L. Smith
*Attorney, Agent, or Firm*—Haseltine and Lake

[57] ABSTRACT

A safety binding for a ski, includes a main circuit for providing a signal to control the release of the binding and thus the freeing of a user's ski boot. The binding includes at least one additional circuit for providing an electrical signal which is independent of signals produced during skiing and which is applied to at least one point of the main circuit to enable simple checking of the condition of the binding.

9 Claims, 2 Drawing Figures

SAFETY BINDINGS FOR SKIS

This is a continuation of application Ser. No. 845,456 filed Oct. 25, 1977, and now abandoned.

The present invention relates to a safety binding for a ski and more particularly the circuit for controlling such a binding whose release for freeing the boot is controlled by a signal coming from an electrical circuit.

Safety bindings for skis are already known comprising one or more electrical circuits, in particular a detection, calculation and release circuit. In this type of binding, this circuit detects stress due to skiing, then makes a calculation and finally emits or does not emit an order sent to the release circuit which releases or does not release a locking member, depending on the level of stress detected and possibly the duration of the application of this stress.

On account of the presence of numerous electrical components and an electrical supply by means of batteries, it will be understood that the risks of a breakdown of such bindings are very varied. Bindings are already known of the aforesaid type, in which an indicator lamp is provided making it possible to check the level of charge of the batteries. However, this check is insufficient, since breakdowns may have other origins: the detection gauges may deteriorate, the various connecting wires may be cut, the electronic components may deteriorate etc. It will thus be easily understood that these breakdowns are very dangerous for the skier, since he may find himself skiing without knowing that his binding is no longer operating.

The present invention intends to remedy the shortcoming of currently known safety bindings of this type, by providing the incorporation in the binding of particularly simple means making it possible to check the correct functional state of the binding permanently.

To this end, this safety binding for a ski comprising at least one main electrical circuit for detection, calculation and release, is characterized in that it comprises at least one additional circuit comprising means for providing an electrical signal independently of the signals produced during skiing, at at least one point of the main circuit.

The electrical signal provided by the additional circuit is measured in order to cause the release of the binding. Furthermore, the skier may use the additional circuit to produce a voluntary removal of this binding, which is particularly advantageous since during the removal, the skier necessarily checks this binding and will consequently become aware of its correct or incorrect operation.

The additional circuit may be a checking circuit and it thus comprises visual and/or sound means to inform the skier of the state of his binding.

According to one variation, the additional circuit may comprise a calibrated mechanical device arranged so as to be able to strike a piezoelectric device with a predetermined force for the purpose of providing a predetermined signal correlatively.

One embodiment of the present invention will be described hereafter, as a non-limiting example, with reference to the accompanying drawings in which.

Figure 1:
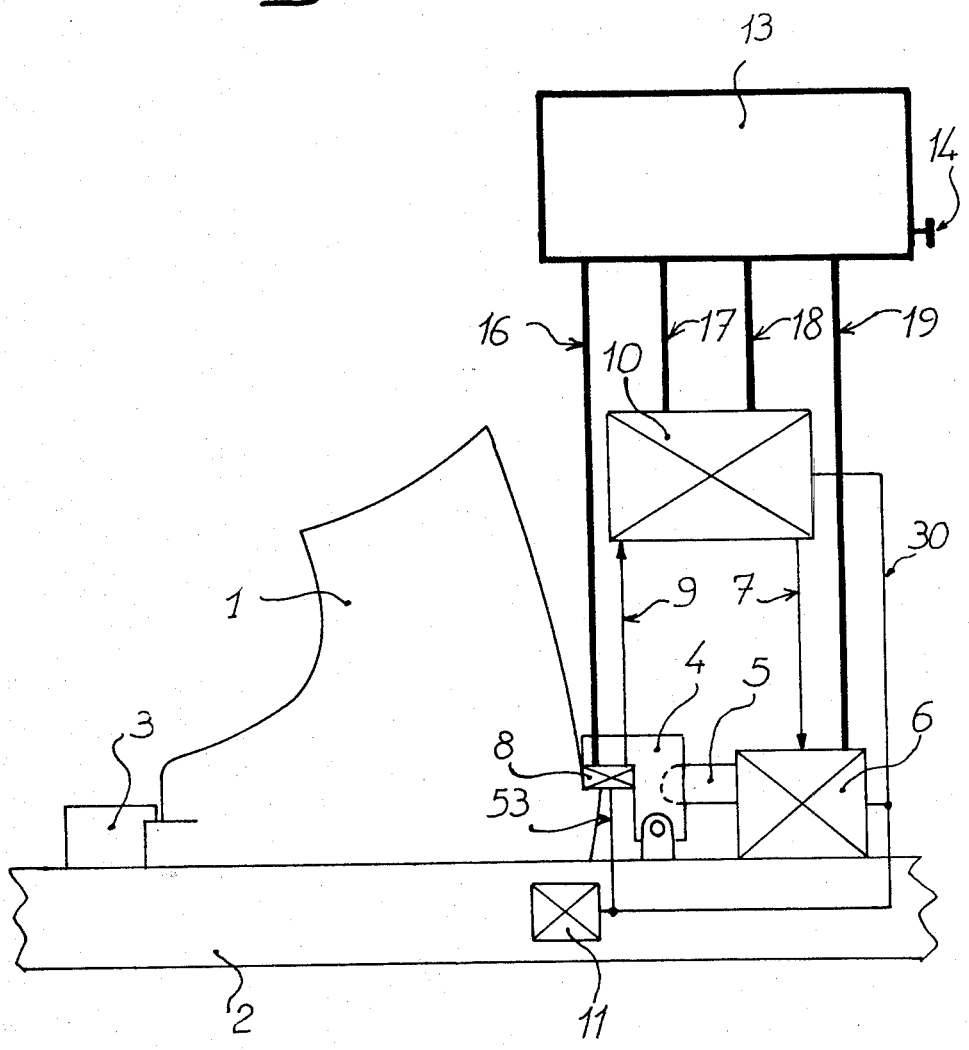
FIG. 1 is a circuit diagram of a main electrical circuit for detection, calculation and release associated with a safety binding retaining a boot on a ski, as well as an additional circuit according to the invention associated with the main circuit.

The safety binding which is illustrated in FIG. 1 is given solely as an example and naturally the invention may be applied to any type of binding having an electrical release.

FIG. 1 shows a boot 1 retained safely on a ski 2 by a front retaining member 3 and a rear retaining member 4. The latter is locked for skiing by a locking member 5. This member 5 may be released, as soon as the stress exerted on the skier's leg may be dangerous for the latter, by a release circuit 6 which is controlled by an electrical signal appearing on a lead 7. The detection of the stress is achieved by a circuit 8 which transmits a signal to a calculation circuit 10 by way of a lead 9. If the stress is not admissible and in particular exceeds a certain level, this circuit 10 sends a signal on the lead 7 to the release circuit 6 and it thus produces unlocking of the member 5 and the release of the boot 1. The circuit 8 for detecting stress, the calculating circuit 10 and the release circuit 6, which together constitute a main electrical circuit in which signals appear at the time of skiing, are connected to an electrical supply source 11 (set of batteries for example) by the leads 53, 30.

Also connected to the main electrical circuit which has been described, which detects the stress, carries out a calculation and emits a release order is an additional circuit 13 according to the invention, which may be set in operation, in particular for the purpose of checking the correct state of the main circuit, by means of a push-button 14. This push-button also facilitates voluntary removal of the binding, as will be seen hereafter. The additional circuit 13 is connected to the circuit 8 for detecting stress by a branch lead 16, to the calculation circuit 10 by the branch leads 17, 18 and to the release circuit 6 by a branch lead 19.

In FIG. 1, the additional circuit 13 is shown as being supplied from the supply 11 of the main circuit. However, it could be connected to an independent supply.

Figure 2:
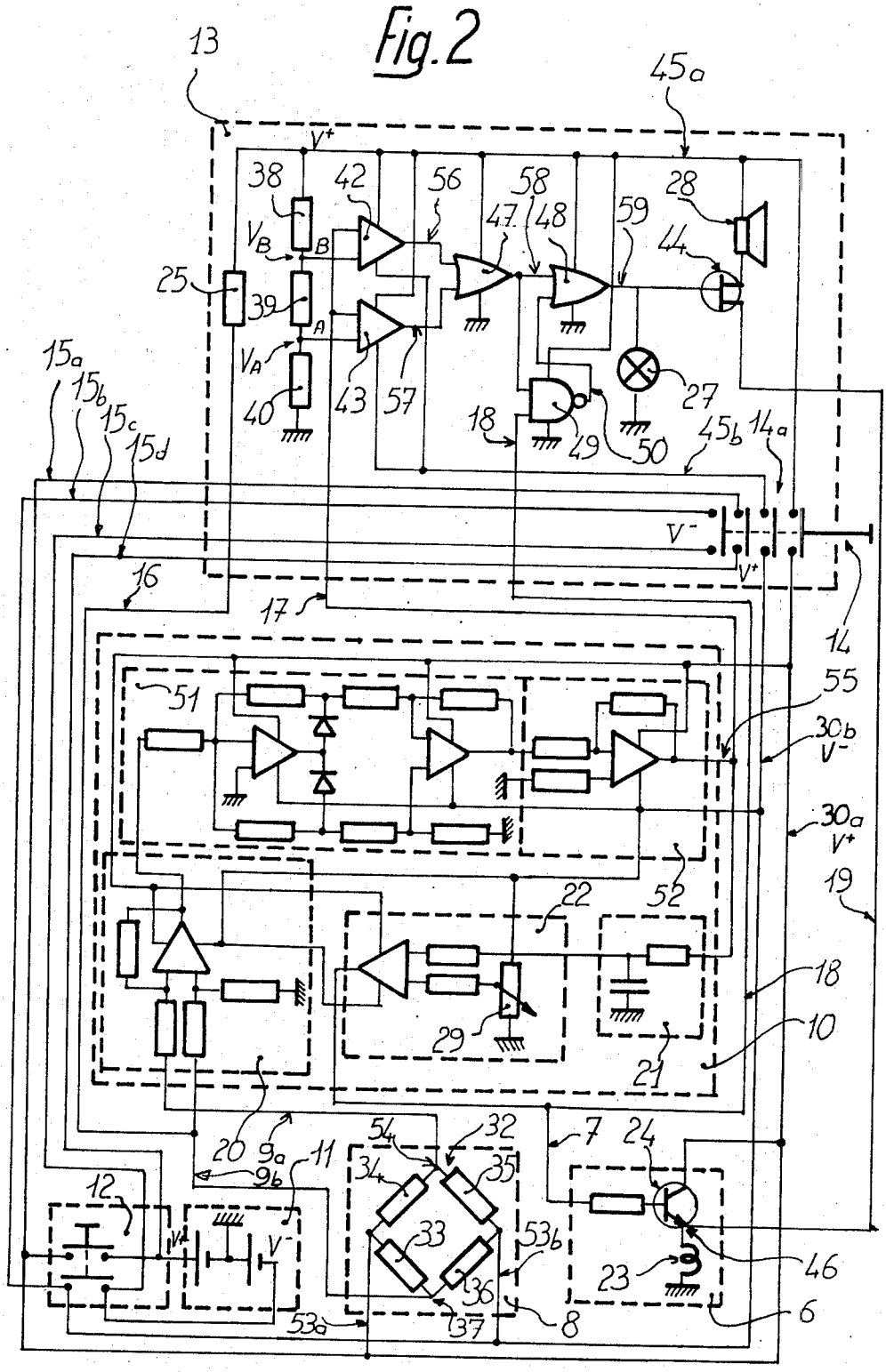
FIG. 2 is an electrical diagram of a particular embodiment of the main electrical circuit and of the additional circuit of the binding.

A non-limiting embodiment of the main circuit and of the additional circuit of the safety binding according to the invention will now be described, with particular reference to FIG. 2.

In this embodiment, the supply of voltage to the circuit takes place at the time of fitting the binding of means of a switch device 12 connected to the supply 11. This switch device 12 is normally open and it is closed only when the boot is held on the ski by the binding. Closure of the switch 12 results in the application of a positive potential V+ and negative potential V− respectively appearing at the terminals of the supply 11, on respective supply leads **30*a*, 15*a* for the V+ potential and 30*b*, 15*b* for the V− potential. The V+ and V− potentials are also permanently present on the leads 15*d*, 15*c* respectively which are connected, in the same way as the leads 15*a*, 15*b*, to a multiple switch 14*a* actuated by the button 14**.

The circuit 8 for detecting stress is constituted by a bridge of gauges 32 comprising four resistors 33, 34, 35 and 36. This bridge is supplied by two branch leads **53*a*, 53*b* connected to two opposed vertices of the bridge and respectively connected to the lead 30*a* having a positive potential and 30*b*** having a negative potential.

The signal leaving the bridge of gauges 32 which corresponds to the stress detected, is transmitted to the calculation circuit 10 which comprises in succession, from its input to its output, an amplifying filter 20, a rectifier 51, an inverter 52, a filter 21 and a threshold circuit 22. This threshold circuit 22 comprises an adjustable resistor 29 which makes it possible to alter the adjustment of the binding. The threshold circuit 22 supplies an output signal which is transmitted by the lead 7 to the release circuit 6. The release circuit comprises by way of example a retaining coil 23 which retains the locking member as long as a current passes therethrough and which on the contrary, releases the latter as soon as it is no longer supplied with current. This coil 23 is connected in series with a transistor 24 to whose base the signal present on the lead 7 is applied through the intermediary of a resistor. Thus, when the binding is to be released, the signal present on the lead 7 is given a low potential, which causes blocking of the transistor 24 and the coil 23 is no longer supplied with voltage. With a release circuit of this type, the skier is warned if the batteries of the supply 11 have deteriorated, since in this case, the coil 23 is no longer supplied with current and the skier would no longer be able to fit his skis, since locking would not take place.

Other breakdowns in the main circuit are detected by means of the additional circuit 13. This circuit is supplied electrically when the push-button 14 is depressed. The multiple switch 14*a* actuated by the push-button 14 comprises two contacts establishing connections respectively between the leads 45*a* and 45*b* and the leads 30*a*, 30*b* respectively of positive and negative potential.

Two other contacts of the switch 14*a* establish connections between the positive potential leads 15*d* and 15*a* on the one hand and between the negative potential leads 15*c* and 15*b* on the other hand, which has the effect of short-circuiting the switch 12. This description enables the skier to check his binding without the necessity of fitting his skis.

The additional circuit 13 comprises a calibrated resistor 25 connected between the lead 45*a* on the one hand and the branch lead 16 connected to one of the vertices 37 of the gauge bridge 32 on the other hand, this vertex also being connected to one input of the amplifier 20.

The additional circuit 13 also comprises an arrangement defining an upper voltage threshold $V_B$ and a lower voltage threshold $V_A$, this arrangement comprising a voltage divider bridge constituted by three resistors 38, 39, 40 connected in series between the lead 45*a* and earth and two operational amplifiers 42 and 43. The first inputs of these operational amplifiers 42 and 43 are respectively connected to the junction points B between the resistors 38 and 39 and A between the resistors 39 and 40. The second inputs of these amplifiers are connected in common, by the lead 17, to the junction point 55 between the inverter 52 and the filter 21.

The outputs 56, 57 of the amplifiers 42 and 43 are connected respectively to the two inputs of an OR-gate 47 whose output 58 is connected to one input of an OR-gate 48. The output of the OR-gate 47 is also connected to one input of a NOT-AND gate 49 whose other input is connected by the lead 18 to the output of the threshold circuit 22. The output of the NOT-AND gate 49 is connected to the second input of the OR-gate 48.

The additional circuit 13 also comprises an indicator lamp 27 which is connected between the output 59 of the OR-gate 48 and earth, as well as a sound warning device 28 connected in series with a field effect transistor 44. The gate of the transistor 44 is connected to the output 59 of the OR-gate 48, whereas its output electrode is connected to the output electrode of the transistor 24 of the release circuit 6, i.e. to the retaining coil 23.

The operation of the additional circuit 13 will now be described.

If the skier wishes to release his binding voluntarily or to check the correct state of the latter, he depresses the push-button 14. In so doing, he causes a supply of current to the circuit 13 and in particular the connection of the calibrated resistor 25. Since the latter is connected to the vertex 37 of the gauge bridge 32, the latter which was previously balanced, is now out of balance and a potential difference appears between the two opposed vertices 37 and 54. This imbalance depends on the value of the resistor 25 and on the correct state of operation of the bridge of gauges. The value of this resistor is such that its intervention in the circuit causes release of the binding. Furthermore, if nothing in the circuit has deteriorated, the check initiated by pressure on the push-button 14 will also cause operation of the sound warning device 28. On the other hand, if there is a problem in the circuits, this sound warning device 28 will not operate, but on the contrary, the lamp 27 indicating a breakdown will light up, as will be seen hereafter.

As seen previously, the resistor 25 is calibrated and is chosen in order to cause, if all is well, an imbalance of the bridge of gauges 32 such that the signal leaving the inverter 52 is sufficient to cause release of the binding whatever the setting of the threshold circuit 22. The output signal of the inverter 52 which appears at the junction point 55 is thus a test potential $V_T$ such that this potential is comprised between the two thresholds $V_B$ and $V_A$ determined by the voltage divider 38, 39, 40. The values of these resistors 38, 39 and 40 which are connected in this order between the positive potential lead 45*a* and earth, are chosen for this purpose. If during skiing, a gauge breaks, the amplifier 20 is in a state of saturation, which causes release of the binding: however, in this case, one cannot know if the latter is a normal release or caused by a deterioration of the electrical circuit or a fault in the supply.

In order to check the state of his binding, the skier thus depresses the push-button 14. If all is well in the electrical circuit, the signal present at the junction point 55 has the test potential $V_T$ in the same manner as the lead 17 which is connected to the second inputs of the operational amplifiers 42 and 43. Since the test potential $V_T$ is by definition comprised between the potential thresholds $V_B$ and $V_A$, the amplifiers 42 and 43 do not supply an output signal, such that the output leads 56 and 57 are at zero. At its output 58, the OR-gate 47 supplies a signal 0, in the same way as the OR-gate 48 at its output 59. Consequently, the indicator lamp 27 is not supplied and the field effect transistor 44 remains open: the sound warning device 28 is supplied since the lead 45*a* has a positive potential. A sound signal is thus emitted, whereas the indicator lamp 27 does not light up, which informs the skier that the circuits of the binding are in a good condition. Furthermore, since the signal present at the junction point 55 has the potential $V_T$, it is sufficient to produce release of the binding. Consequently, to summarise, if nothing has deteriorated in the circuits, a voluntary release of the binding is obtained, a sound signal is emitted by the warning device 28, whereas the lamp 27 indicating a breakdown does not light up.

On the other hand, if the release is due to the rupture of a gauge, the amplifier 20 passes to a state of saturation and the signal present at the output 55 of the inverter 52 has a positive potential. In this case, when the skier depresses the push-button 14 for the purpose of checking, this positive potential is applied by the lead 17 to the second inputs of the operational amplifiers 42 and 43. Since the lead 17 thus carries a positive potential which is greater than the upper potential threshold $V_B$, at its output 56, the amplifier 42 supplies a signal in the state 1 which is transmitted by way of the OR-gates 47 and 48. The signal 1 present at the output 59 of the gate 48 firstly causes a supply of the lamp 27 indicating a breakdown and secondly blocking of the field effect transistor 44. The skier is thus informed of the deterioration of the bridge of gauges 32 owing to the fact that the lamp 27 for indicating a breakdown lights up and the sound warning device 28 does not operate.

Another cause of a breakdown in the circuit is the blocking of the bridge of gauges 32 in the state zero (for example at the time of a short circuit). When the skier depresses the push-button 14, the bridge of gauges cannot be put out of balance, despite the presence of the resistor 25, owing to the fact that it is blocked at zero. Consequently, the signal present at the output 55 of the inverter 52 is at zero, therefore at a level lower than the lower potential threshold $V_A$. The potential zero present on the lead 17 is thus applied to the second inputs of the amplifiers 42 and 43 and at its output 57 the amplifier 43 supplies a signal at state 1. The two OR-gates 47, 48 transmit this signal 1 as previously, such that the indicator lamp 27 lights up and the sound warning device 28 does not operate. In this case also, the skier is informed that there is a problem in the electrical circuits.

If the amplifier 20 has deteriorated, the signal which appears at the junction point 55, when the push-button 14 is depressed, is not at the normal test potential $V_T$. Depending on the case, it is the operational amplifier 42 or 43 which emits a signal at state 1 and as previously, the indicator lamp 27 lights up and the sound warning device 28 is not supplied with current. The method is the same as in the case of deterioration of the circuits 51 and 52.

In the case where the filter 21 has deteriorated (for example if the condenser has been short-circuited), when the push-button 14 is depressed, one thus creates the imbalance provided and the signal at the junction point 55 is at a potential comprised between $V_B$ and $V_A$. The amplifiers 42 and 43 are thus blocked, the signals on the outputs 56 and 57 are at the state zero, like the signal at the output 58 of the OR-gate 47. In parallel manner, the threshold circuit 22 does not change state and its output remains at the state zero. This information is thus transmitted by the lead 18 to the NOT-AND gate 49. Since the two inputs of this gate are simultaneously at the state zero, the signal at its output 50 is at the state 1 and the result of this is that the signal at the output 59 of the OR-gate 48 is also at state 1. The indicator lamp 27 is thus supplied and the sound warning device 28 does not operate.

If the coil 23 has broken, a release of the binding occurs, but the return by the lead 19 does not take place and consequently the sound warning device 28 is not supplied with current.

What is claimed is:

1. A safety binding for a ski comprising: at least one main electrical circuit for producing signals during skiing to detect and calculate stress on the binding and to control the release of the binding in dependence upon the stress, and being further defined by at least one voluntary operated additional circuit operated by a switch and including warning means and employing active circuit elements for generating an electrical signal at at least one point in said main circuit, and actuating the warning means for warning of the state of the binding, said electrical signal being independent of said signals produced during skiing, to thereby enable monitoring of the condition of said binding.

2. A safety binding according to claim 1, wherein: the additional circuit includes resistive circuit means for producing a calibrated signal to the main circuit such that its intensity causes the release of the boot when a predetermined value is met.

3. A safety binding according to claim 1, in which the additional circuit comprises a push-button controlling a switch whereof two contacts which are normally open are connected between the constituent parts of said additional circuit and an electrical supply source for the binding, whereby said additional circuit and said supply source are connected when said push-button is pressed.

4. A safety binding according to claim 3, comprising a further switch which is normally open connected between said supply source and said main circuit of the binding, said further switch being closed when a boot is placed in the binding, wherein said push button controlled switch comprises two additional contacts for short-circuiting said further switch when the said push-button is pressed.

5. A safety binding according to claim 3, in which said main circuit comprises a bridge of gauges for detecting stress, an amplifier, a rectifier, an inverter, a filter, a threshold circuit, and a release circuit, and in which said additional circuit comprises a calibrated resistor connected by a lead to a first input of said amplifier and to a first vertex of said bridge of gauges, a second vertex of said bridge of gauges being connected to a second input of said amplifier, the value of said calibrated resistor being such that when the push-button is pressed a signal appears at an output of said inverter which signal is at a test potential $V_T$ sufficient to cause release of the binding whatever the setting of said threshold circuit.

6. A safety binding according to claim 5, in which said additional circuit comprises an arrangement defining an upper voltage threshold $V_B$ and a lower voltage threshold $V_A$, said arrangement being connected by a lead to said output of said inverter of said main circuit and emitting at an output a first signal if said output of said inverter has a potential between said thresholds $V_B$ and $V_A$ and a second signal if said output of said inverter is not between said thresholds $V_B$ and $V_A$, means being provided for indicating to a user the state of said output of said arrangement.

7. A safety binding according to claim 6, in which said arrangement comprises three resistors connected in series between a lead at potential V and earth, junction points between said resistors being connected to first inputs of two operational amplifiers, second inputs of which are connected in common to said output of said inverter and a first OR-gate having two inputs respectively connected to outputs of said two operational amplifiers, said first OR-gate having an output supplying a signal whose state indicates the operational condition of the binding.

8. A safety binding according to claim 7, in which said additional circuit comprises a second OR-gate having a first input connected to said first OR-gate and an output connected to an indicator lamp and to a control electrode of a transistor, said transistor being connected in series between a sound warning device of said additional circuit and a coil forming part of a release circuit for the binding.

9. Safety binding according to claim 8, in which additional circuit comprises a NOT-AND gate having a first input connected to said output of said first OR-gate and a second input connected by a lead to a junction point between said threshold circuit and said release circuit of the main circuit, an output of said NOT-AND gate being connected to a second input of said second OR-gate.

* * * * *